United States Patent [19]

Sinka

[11] Patent Number: 4,780,959

[45] Date of Patent: Nov. 1, 1988

[54] RAZOR ADAPTOR

[76] Inventor: Laslo B. Sinka, 27 Santa Barbara Rd., Willowdale, ON. M2N 2C1, Canada

[21] Appl. No.: 7,140

[22] Filed: Jan. 27, 1987

[51] Int. Cl.[4] ..... B26B 21/14

[52] U.S. Cl. ..... 30/83; 30/47

[58] Field of Search ..... 30/279, 67, 51, 83, 30/47

[56] References Cited

U.S. PATENT DOCUMENTS 3,593,416 7/1971 Edson ..... 30/67 X

*Primary Examiner*—Frank T. Yost

*Assistant Examiner*—Willmon Fridie, Jr.

[57] ABSTRACT

A shaving implement which is a razor adaptor to prepare the skin ahead of the blade(s) for better shaving. It comprises at it's center part: a pivotal mounting means for attaching to a handle; secured to the center part a spring leaning against the handle's head to prevent the handle from falling over a skin stretching means which is secured to a center part and forms one end of the bridge, while at the other end of the bridge it comprises a pivotal mounting means for attaching to a blade cartridge.

7 Claims, 2 Drawing Sheets

RAZOR ADAPTOR

CROSS-REFERENCE TO RELATED APPLICATION

Canadian Patent Application No. 500,367 Cl.30 Sub.Cl.34 Div.5, filed 1986 Jan. 24, in the name of the present inventor.

BACKGROUND OF THE INVENTION

1. Field of the Invention

The invention relates to a razor adaptor attached to a wet shaving system and is directed more particularly to produce constant skin formation ahead of the cartridge to suit the blade(s) for optimum shaving.

2. Description of the Prior Art

No razor systems up until now have had any provision for skin preparation ahead of the cartridge to suit the blade(s) by lifting up the hairs from the wrinkles, while preventing skin damage.

Contrary, when the cartridge of the present systems engages the face, it inevitably sinks into the skin under the slightest pressure, forming a hollow, in which the hairs sit deeper in the wrinkles. Great advances have been achieved in this field to correct this deficiency of the razor systems, yet the shaving is still a two hand job, a face making struggle and a slow procedure, particularly under the jaw and around the neck. Above all, the blade(s) under an increased pressure not only cut(s) the hairs at a high point, but even cut(s) the tip of the wrinkles as well, resulting irritation and skin damage.

SUMMARY OF THE INVENTION

An object of the present invention is to provide a device delivering the smothest possible skin surface to the blade(s) first to prevent skin damage and irritation, secondly for higher efficiency of shaving and finaly to make the shaving more confortable and easy procedure.

To achieve above object, the inventive device is interconnected between a cartridge and a handle and distributes most of the pressure from the handle onto a skin stretching bar, running parallel and—in operation—ahead of the cartridge and only a minimal fraction of the pressure goes onto the blade(s). Provision is given to select a preferred range of said pressure distribution.

As the skin stretching bar receiving most of the pressure from the handle, it presses strongly onto the skin surface and thus pushes the skin ahead of the bar upward so, that the skin behind it not only stretches, but forms an arcuate or arch shape. And this creates a favorable stretched skin condition for shaving commonly done by professional barbers (with a single blade knife). The cartridge is lifted on top of the arch literally sliding over a perfect smooth surface, where the hairs are lifted up on a highest possible position for optimum shaving.

With the above and other abjects in view, as will hereinafter appear, a feature of the present invention is the provision of a razor adaptor comprising a pair of arms having pivotal mounting means for connection to a blade cartridge, a center portion as continuation of said pair of arms and having pivotal mounting connections to a cooperating handle and for selecting a preferred range of pressure distribution from the handle between the cartridge and the skin stretching bar fixed to the free ends of the center portion and parallel to and—in operation—ahead of the cartridge. Closer the handle is to the bar, havier is the pressure on it and less on the blade(s).

Contrary to existing systems this device is more effective in areas, where the skin is flacid, like under the jaws and around the neck. The friction of the bar is important. It is even advisable to wash the soap off the face after the hairs got softened for increased efficiency, and easier shaving. Even right after the use of towel (while the hairs are still soft), missing spots could be shaved, leaving no irritation at all. Experience with prototype indicates, that a single blade is satisfactory.

The device is simple. It could be made partly or entirelly of plastic; easy to manufacture; production cost is low; easy to operate by one hand; no mirror is necessary; in fact the shaving—from all points of view—is best under a shower. Furthermore a potential demand is existing for such a device from those with sensitive skin, who can not use the present safety razor systems, because of skin irritation. The above and other futures of the invention, including various novel details of construction will now be more particularly described with reference to the accompanying drawings and pointed out in the claims.

It will be understood that the particular device embodying the invention is shown by way of illustration only and not as a limitation of the invention. The principles and futures of this invention may be employed in various and numerous embodiments without departing from the scope of this invention.

BRIEF DESCRIPTION OF THE DRAWINGS

Reference is made to the accompanying drawings in which is shown an illustrative, preferred embodiment of the invention from which it's novel features and advantages will be apparent.

In the drawings

In FIGS. 1 to 4 the cartridge (A), the handle (B) and the skin (C) are used for illustrative purposes only and not subject to this invention.

DESCRIPTION OF THE PREFERRED EMBODIMENT

Figure 1:
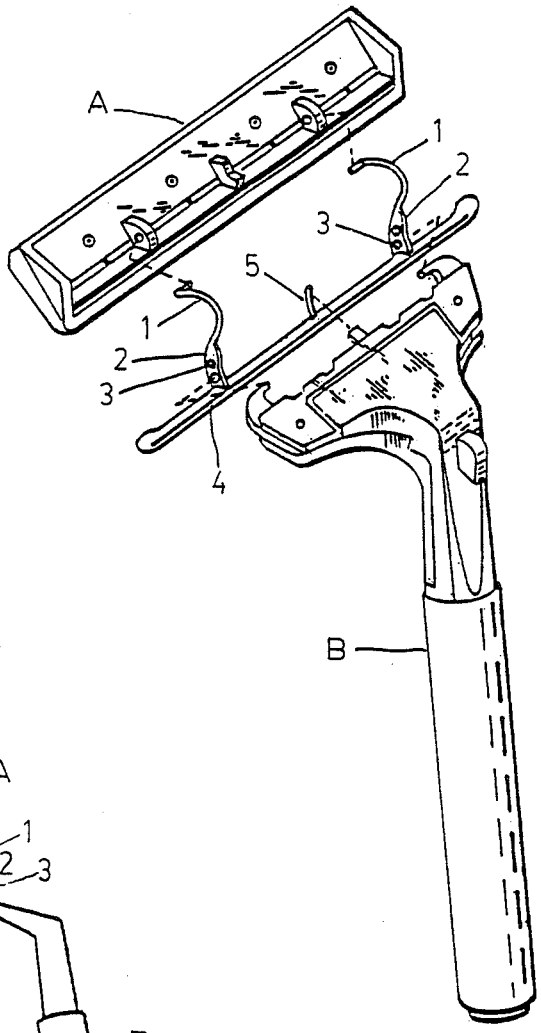
FIG. 1 is an exploded perspective view of the razor adaptor illustrative of the invention in related position to a blade cartridge (A) and a razor handle (B) to which the adaptor is to be interconnected.

Refering to the drawings, it will be seen, that an illustrative razor adaptor comprises a pair of—tempered material—arms (1) parallel to one to another, with their end pieces bent 90 degrees toward each other, forming outwardly and manually extendable flanges for pivotal mounting connection between said arms and cartridge (A) complementary to conventional cartridges by engaging the sides of the channel formed on the underside of the cartridge; continuation of said arms (1) are flattened so that their inner sides are facing each other and said flattened parts of said arms (1) constitute the center portion (2), sharing a plural pairs of openings (3) forming complementary multiple pivotal mounting connection to a conventional razor handle for connection between the adaptor and a handle by engageing the flanges on the connecting portion of handle (B) to any preferred pair of openings (3) whereby also selecting a preferred range of pressure distribution from said handle (B) between blade cartridge (A) and skin stretching bar (4) which is perpendicularly fixed to the free end pieces of said center portion (2) to eliminate the wrinkles by constantly stretching and arching the skin ahead of the cartridge (A). Closer is the connection between the handle (B) and the adaptor to said bar (4), higher pressure is distributed to said bar (4) and less onto the blade cartridge (A).

Arms (1) and it's continuation as center portion (2) are identically arched from the channel of the cartridge (A) across the underside of said cartridge (A) toward and over the guard bar member of cartridge (A) in a suitable distance to provide adequate clearance to cartridge (A), whereby said cartridge (A) has a full range of pivoting movement. From this point gradually changing direction—still away from said channel and in same plane—resulting in an assymptotic curve relative to the top plane of said cartridge (A) in resting pivoting position. The skin stretching bar (4) must have a highly frictional surface, preferably fluted and coated with rubber in order to achieve higher efficiency. Washing the soap off the face after the hairs are softened, greatly increases the friction of bar (4) and improves efficiency, satisfactory even with single blade. This increased friction does not effect the cartridge (A) even without the superslippery strip on the late model of cartridges, because the pressure on the cartridge (A) is so gentle, that it is hardly touching the skin surface. The structure of the adaptor is strongtened by a T shaped brace (5) having a web portion and a leg portion perpendicular to said web portion being fixed to the arms (1) at it's meeting point with the center portion (2) and said leg portion is fixed to the skin stretching bar (4).

Figure 2:
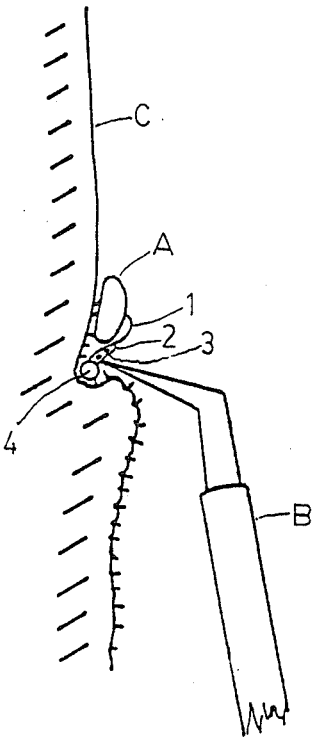
FIG. 2 illustrates the side view of the adaptor attached to a razor system in operation.

FIG. 2 represents the side view of embodiment of the invention interconnected between the cartridge (A) and the handle (B) in relation to the skin (C) and illustrates the operating principle of the invention.

Figure 3:
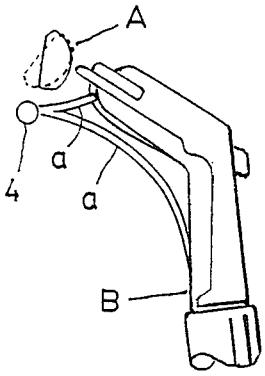
FIG. 3 illustrates the side view of the skin stretching bar attached to the handle of the razor system.
Figure 4:
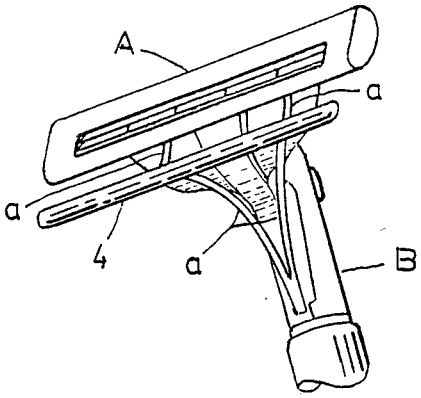
FIG. 4 is a perspective view of FIG. 3.

Other ways in which the invented idea may be used or put into operation are as follows:

(a) The skin stretching bar member (4) of the razor adaptor could be permanently or temporarly attached—by an interconnected brace (a)—to the connecting side of a razor handle (B) and said bar (4) will extend in a spaced manner below and parallel to the razor cartridge (A) of the system—as illustrated in FIGS. 3 and 4—whereby said bar (4) could engage with a skin surface for better shaving. Pressure contol being manual, the results are less.

Figure 5:
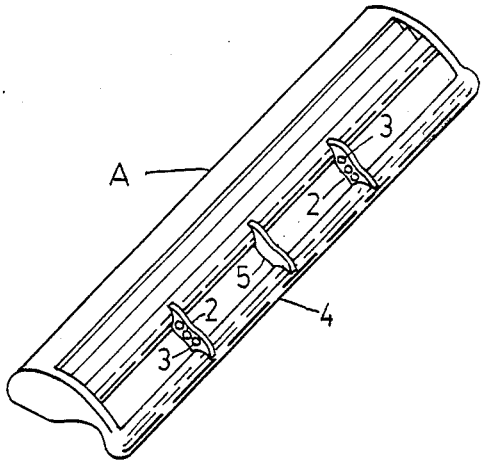
FIG. 5 illustrates a perspective view of the adaptor permanently built into a razor cartridge.

(b) Having the arms (1) and the web portion of T shaped brace (5) eliminated, the razor adaptor could be permanently or temporarly attached—by the free end parts of center portion (2)—to the housing of a conventional cartridge (A) and parallel to said cartridge (A) as illustrated in FIG. 5. The guard bar member of said cartridge (A) could be ignored, similarly the extending part of the end portion of cartridge (A) between said housing and said bar (4) could also be left out if said bar (4) is made strong enough to do the job. Having the blade(s) and said housing stationary, the results are less.

It is to be understood that the present invention is by no means limited to the particular construction herein disclosed and/or shown in the drawings, but also comprises any modification or equivalents within the scope of the disclosure.

The embodiments of the invention in which an exclusive property or privilage is claimed are defined as follows:

1. An adaptor for use with a shaving razor comprising a pair of mutually parallel springy arm means adapted to engage with a razor cartridge, said razor cartridge having mounting channel formed at the under-side therein, said arm means having a center portion being a continuation of said arm means provided with a plurality of openings for coupling with a razor handle, a bar means attached to the lower ends of said center portion and extending perpendicular to said center portion and said bar means extending outwards in a spaced manner below said razor cartridge when said razor cartridge and said handle are mounted to the adaptor, a leg means attached to said bar means at the center point between and parallel to said center portion and operative for actuating a latching device provided on said handle and to maintain the adaptor within a predetermined position relative to said handle.

2. A razor adaptor in accordance with claim 1 in which the pair of arm means is being tempered material having free end portions bent toward eachother forming outwardly and manually extendable flanges for pivotal mounting connection with two sides of said channel.

3. A razor adaptor in accordance with claim 2 in which said handle being engageable with a selected pair of openings in said center portion of said arm means to provide a selected range of pressure distribution between said razor cartridge and said bar means.

4. A razor adaptor in accordance with claim 3 in which said pair of arm means and said center portion being arched around the underside of the cartridge to provide a clearance to said cartridge whereby said cartridge has a full range of pivotal movement.

5. A razor adaptor in accordance with claim 4 in which said bar means has a surface portion disposed perpendicular to the free ends of said center portion, said surface being frictional and fluted and operative in shaving for constant stretching and arching a skin surface to provide an optimum shave.

6. A razor adaptor in accordance with claim 5 in which said bar means is coated with a frictional material in the group consisting of rubber and vinyl to increase the friction.

7. In a razor cartridge, an adaptor forming an integral part of a cartridge housing, said housing having a skin stretching means comprising a bar means extending in a spaced manner below and parallel to a lower portion of said housing, a pair of parallel arm means connected to and extending between said housing and said bar means, a plurality of openings formed in said pair of arm means, said openings being operative for selected engagement with a razor handle, a leg means connected to and extending between said housing and said bar means and located between and parallel to said arm means and operative to activate a latching means in a razor handle attached to said cartridge.

* * * * *